United States Patent [19]

Kishino et al.

[11] 4,190,787

[45] Feb. 26, 1980

[54] PHOSPHORUS LUMINESCENT DISPLAY TUBE

[75] Inventors: Takao Kishino; Yoichi Mera; Satoru Makita; Tsutomu Morooka, all of Mobara, Japan

[73] Assignee: Futaba Denshi Kogyo Kabushiki Kaisha, Chiba, Japan

[21] Appl. No.: 914,948

[22] Filed: Jun. 12, 1978

[30] Foreign Application Priority Data

Jul. 7, 1977 [JP] Japan ..... 52-80439

[51] Int. Cl.[2] ..... H01J 63/02; H01J 63/06

[52] U.S. Cl. ..... 313/494; 313/497

[58] Field of Search ..... 313/496, 497, 494, 513, 313/519

[56] References Cited

U.S. PATENT DOCUMENTS

| | | | |
|---|---|---|---|
| 3,508,101 | 4/1970 | Tanji | 313/497 |
| 3,668,466 | 6/1972 | Shimada | 313/497 X |
| 3,780,326 | 12/1973 | Raago | 313/496 |
| 4,047,072 | 9/1977 | Kishino et al. | 313/496 |

FOREIGN PATENT DOCUMENTS

| | | | |
|---|---|---|---|
| 2107604 | 8/1971 | Fed. Rep. of Germany | 313/519 |
| 2348186 | 4/1974 | Fed. Rep. of Germany | 313/497 |

*Primary Examiner*—Palmer C. Demeo

*Attorney, Agent, or Firm*—Oblon, Fisher, Spivak, McClelland & Maier

[57] ABSTRACT

A phosphorus luminescent display tube of the triode type having, in a vacuum casing, a filamentary cathode for emitting thermions, a control electrode for accelerating and controlling the thermions emitted from the cathode, a plurality of pattern display sections each composed of a plurality of segment anodes each coated with a phosphor layer for emitting light when the thermions impinge thereon, the segment anodes being selectively given an anode potential, and auxiliary anode conductors provided in the vicinity of and substantially on the same level with the segment anodes and kept positive with respect to the filamentary cathode so as to absorb electron oscillations occurring in the vicinity of the segment anodes to which the anode potential is not given.

5 Claims, 4 Drawing Figures

PHOSPHORUS LUMINESCENT DISPLAY TUBE

BACKGROUND OF THE INVENTION

1. Field of the Invention

The present invention relates to a phosphorus luminescent display tube which gives no noise trouble and the like to the electronic equipment positioned in the vicinity thereof.

2. Description of the Prior Art

Generally, a phosphorus luminescent display tube can be driven on a low voltage, being low in power consumption. In addition, such emits a very bright blue-green light which is easy to see. Thus, such is extensively used for various display devices.

Basically, the phosphorus luminescent display tube is composed of a filamentary cathode (hereinafter referred to as a filament) for emitting thermions when energized and heated in a vacuum inside the tube, and a pattern display section having a plurality of segment anodes (for instance, seven segment anodes arranged in the form of the numeral 8) each coated with a phosphor layer and selectively kept positive with respect to the abovementioned filament, whereby the thermions emitted from the filament impinge on the anodes kept positive with respect to the filament to make them luminesce for display. In the case of the multi-digit display tube, a plurality of pattern display sections are provided which are adapted to selectively display a plurality of patterns, figures and the like for multi-digit display.

Also, most of the phosphorus luminescent display tubes of the above type are usually of the so-called triode type in which the thermions emitted from the filament are accelerated and controlled so that they may impinge uniformly on each pattern display section and at the same time desired pattern display sections may be selected for display by providing, for instance, a mesh-shaped control electrode between the filament and each pattern display section or all the pattern display secitons in common.

Moreover multi-digit phosphorus luminescent display tubes are generally classified into two types in terms of the drive system, namely, the dynamic drive type and the static drive type. In the dynamic drive type tube, the corresponding segment anodes of the respective digits or pattern display sections are connected in common, and a plurality of control electrodes, one for each digit or pattern display section, are provided electrically independently of one another. Thus, display signals are given to the corresponding segment anodes of the respective digits while digit-selecting signals are given to the control electrodes in a time-sharing manner so that a desired display may be obtained. In the static drive type tube, a fixed control voltage is given to the control electrodes connected electrically in common while display signals are given to the segment anodes of the respective digits on a digit-by-digit basis so that a desired display may be produced. Either of these systems may be chosen according to the number of digits and the ambient operating conditions.

In the dynamic drive system, for instance, the digit-selecting signals are fed as pulses. These pulse signals generate, during the rise time or fall time, high frequencies which may cause noises in the external equipment. Therefore, the phosphorus luminescent display tubes for use as the display devices of radios, televisions, various measuring instruments and the like which must be prevented from noises often adopt the static drive system.

As mentioned above, such luminescent display tubes are becoming extensively used in displaying applications such as the numerical display of the results of registering, computation and the like, time display of digital time-pieces, and the display of transmitting or receiving frequencies and channels of the radio equipment including radios and televisions.

With the spread of the application range of such luminescent display tubes, it has been found that such have the following disadvantage.

When the phosphorus luminescent display tube of the triode type mentioned above is used for channel display or time display in the vicinity of an electronic equipment, for instance, a television, whose working frequency ranges from 100 MHz to several hundred MHz, the display tube emits noises falling within the above-mentioned frequency band, and thereby generates noise troubles to the electronic equipment, for instance so as to cause flicker in the television picture. The occurrence of the above-mentioned noises is very frequent especially when there are a number of segment anodes to which the anode potential is not given.

Accordingly, the inventors of the present invention have carefully investigated the causes of the occurrence of the above-mentioned noises and, as a result, reached the following conclusion.

No such conclusion will be hereinafter described with reference to FIG. 1 which shows the basic arrangement of the phosphorus luminescent display tube of the triode type mentioned above. In FIG. 1, reference numeral 1 designates an insulating substrate made of, for instance, glass or ceramics, on which are provided in a laminated manner wiring conductors 2, insulating layers 3 each having a through-hole 4, and segment anode conductors 5 electrically connected to the corresponding wiring conductors 2 through the corresponding through-holes 4. The segment anode conductors 5 are coated on the upper surfaces thereof with phosphor layers 6, respectively, to form segment anodes *7a* and *7b*.

In addition, a filament 8 is provided opposite to and above the segment anodes *7a* and *7b* for emitting thermions ⊖ when energized and heated. Between the filament 8 and the segment anodes *7a* and *7b*, there is provided a control electrode 9 kept at a positive potential substantially equal to the anode potential. The control electrode 9 may be formed, for instance, in a mesh shape so that the emission of light from the segment anodes *7a* and *7b* may be clearly seen. Though not shown, a front bulb with a transparent observation window is bonded to the insulating substrate 1 along the peripheries thereof to form a high-vacuum casing for airtightly sealing the above-mentioned electrodes so that these electrodes may be externally energized.

With the above-mentioned construction, this phosphorus luminescent display tube may be operated as follows.

When the segment anode *7a* is given an anode potential through the wiring conductor 2 and, on the other hand, the segment anode *7b* is not given the anode potential but is instead kept at about the same potential as the filament 8, thermions ⊖ emitted from the filament 8 are accelerated by the control electrode 9 which is kept positive with respect to the filament 8, impinging on the phosphor layer 6 of the segment anode *7a* to thereby make the segment anode *7a* emit light. Meanwhile, thermions ⊖ moving toward the segment anode 7*b* to which the anode potential is not given are first accelerated by the control electrode 9 kept positive with respect to the filament 8, moving further toward the segment anode 7*b* through the mesh of the control electrode 9. However, since the segment anode 7*b* is kept at about the same potential as the filament 8 as mentioned above, these thermions ⊖ cannot reach the segment anode 7*b*, being repelled thereby and accelerated in the reverse direction toward the control electrode 9. After thus passing through the mesh of the control electrode 9, these thermions ⊖ are again made to reverse the moving direction thereof by the action of the control electrode 9, being accelerated toward the control electrode 9 again. These operations of thermions ⊖ are repeated to produce electron oscillations about the control electrode 9 in the vicinity thereof, and these electron oscillations create electromagnetic waves, which are radiated outside to generate noise troubles to the adjacent electronic equipment.

More particularly, the electromagnetic waves produced by the above-mentioned electron oscillations correspond to those produced by the Barkhausen-Kurz oscillation in the case of common electron tubes. Accordingly, these waves have frequencies of the order of MHz and therefore cause noise troubles in the adjacent electronic equipment such as televisions which deal with signal components in the frequency range of about 100 to several hundred MHz.

BRIEF SUMMARY OF THE INVENTION

The present invention is intended to eliminate the above-mentioned disadvantages of the prior art and to provide a new and novel phosphorus luminescent display tube.

Therefore, it is an object of the present invention to provide a phosphorus luminescent display tube which does not give rise to noise troubles to the adjacent electronic equipment.

It is another object of the present invention to provide a phosphorus luminescent display tube which does not radiate high-frequency electromagnetic waves that may form a source of noise troubles of the adjacent electronic equipment.

It is still another object of the present invention to provide a phosphorus luminescent display tube which can be driven on a low voltage, is low in power consumption is easy to see.

According to the present invention, there is provided a phosphorus luminescent display tube of the triode type which comprises a vacuum casing made up of a substrate and a front bulb bonded to each other, a filamentary cathode provided in the above-mentioned casing for emitting thermions when energized and heated, a control electrode provided in the above-mentioned casing for accelerating and controlling the thermions emitted from the filamentary cathode, a plurality of pattern display sections each composed of a plurality of segment anodes with each being coated with a phosphor layer for emitting light when the above-mentioned thermions impinge thereon, the foregoing segment anodes being selectively given an anode potential, and auxiliary anode conductors provided in the vicinity of and substantially on the same level with the segment anodes of the above-mentioned pattern display sections so as to absorb electron oscillations occurring in the vicinity of the segment anodes to which the anode potential is not given.

BRIEF DESCRIPTION OF THE DRAWINGS

Various other objects, features and attendant advantages of the present invention will be more fully appreciated as the same becomes better understood from the following detailed description when considered in connection with the accompanying drawings, wherein like reference characters designate like or corresponding parts throughout the several view, and wherein.

DETAILED DESCRIPTION OF THE PREFERRED EMBODIMENTS

A preferred embodiment of the present invention will be hereinafter described with reference to FIGS. 2 and 3.

In this preferred embodiment, a pattern display section corresponding to one digit is composed of seven segment anodes arranged in the form of a FIG. 8. For brevity, FIGS. 2 and 3 show only one pattern display section corresponding to one digit.

Figure 1:
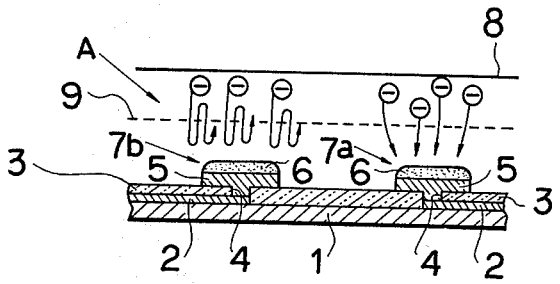
FIG. 1 (PRIOR ART)
FIG. 1 is a schematical sectional view of a conventional phosphorus luminescent display tube prepared for the purpose of explaining the operation of the tube.
Figure 2:
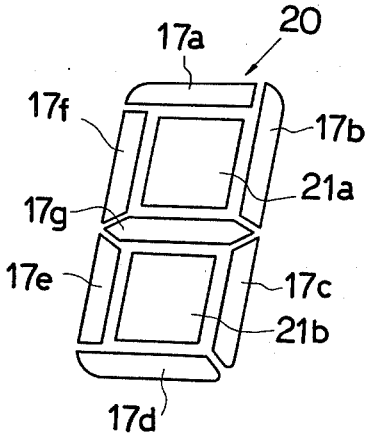
FIG. 2 is a plan view of the essential part of a phosphorus luminescent display tube according to a preferred embodiment of the present invention.
Figure 3:
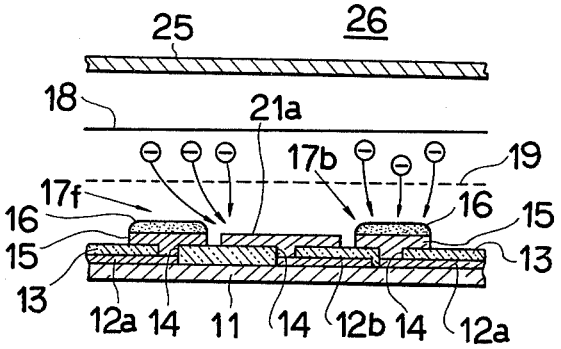
FIG. 3 is an elevational sectional view of the preferred embodiment of the present invention.

In FIGS. 2 and 3, reference numeral 11 designates an insulating substrate on which are provided are wiring conductors 12*a* for segment anodes and also wiring conductors 12*b* for auxiliary anode conductors to be later described. In addition, an insulating layer 13 with through-holes 14 at predetermined positions is laminated on the insulating substrate 11 so that the wiring conductors 12*a* and 12*b* may be sandwiched therebetween. Anode conductors 15 are provided on the insulating layer 13 so that they may be electrically connected to the corresponding wiring conductors 12*a* through the through-holes 14. Moreover, the anode conductors 15 are coated, on the upper surfaces thereof, with phosphor layers 16, respectively, to form segment anodes 17*a* to 17*g*. The segment anodes 17*a* to 17*g* constitute a pattern display section 20 corresponding to one digit.

Reference numerals 21*a* and 21*b* designate auxiliary anode conductors made of conductive material (for instance, the same conductive material as the anode conductors 15) and provided on the insulating layer 13 in the vicinity of the segment anodes 17*a* to 17*g*. The auxiliary anode conductors 21*a* and 21*b* are electrically connected to the corresponding wiring conductors 12*b* through the throughholes 14 formed in the insulating layer 13.

Reference numeral 18 designates a filamentary cathode, or filament, stretched above and opposite to the pattern display section 20 for emitting thermions when energized and heated. Reference numeral 19 designates a control electrode in the form of, for instance, a mesh provided between the pattern display section 20 and the filament 18.

Reference numeral 25 designates a front bulb having a transparent observation window occupying at least the area facing the pattern display section 20. The front bulb 25 is airtightly bonded to the insulating substrate 11 to form a casing 26. The casing 26 is so formed that it may contain the above-mentioned electrodes and other parts with the inside thereof being kept at a high vacuum such that the above-mentioned electrodes may be energized from the outside of the casing 26 by lead-wires (not shown) air-tightly passing through the casing 26.

With the above construction, the luminescent display tube of the present invention may be operated as follow.

The control electrode 19 continuously has a positive potential equal to, for instance, the anode potential, when the display tube is driven by the static drive system to make the segment anodes 17*a* to 17*g* selectively luminesce for the display of patterns such as characters and figures.

Meanwhile, the auxiliary anode conductors 21*a* and 21*b* are given an equal positive potential as the control electrode 19 by electrically connecting the wiring conductors 12*b* either directly inside the casing 26 or indirectly through the external terminal of the control electrode 19 outside the casing 26. However, positive potential may be given to the auxiliary anode conductors 21*a* and 21*b* independently through the external terminals of the wiring conductors 12*b*.

When energized and heated, the filament 18 emits thermions ⊖, which are accelerated by the control electrode 19 and impinge on the segment anode, for instance, 17 *b* to which an anode potential is selectively given. Thus, the phosphor layer 16 of the segment anode 17*b* is excited to luminesce and can be seen from the outside through the front bulb 25.

If, for instance, the display of the numeral "1" is desired, the segment anodes 17*b* and 17*c* are given a positive anode potential while the segment anodes 17*a*, 17*d*, 17*e*, 17*f* and 17*g* are not given the anode potential, being kept at substantially the same negative potential as the filament 18.

In this case, therefore, thermions ⊖ emitted from the filament 18 and accelerated by the control electrode 18 impinge on the segment anodes 17*b* and 17*c* to which the anode potential is given, and as a result the segment anodes 17*b* and 17*c* emit light to display the numeral "1". Meanwhile, thermions ⊖ emitted from the portion of the filament 18 positioned opposite to and in the vicinity of the negative-potential segment anode, for instance, 17*f* are first accelerated by the control electrode 19 and initially move toward the segment anode 17*f*. However, such are repelled by the action of the negative potential of the segment anode 17*f* so as to change their direction of movement, and these thermions ⊖ are then attracted and flow into the auxiliary anode conductor 21*a* provided in the vicinity of the segment anode 17*f* and kept positive at all times, being then fed to an external circuit through the auxiliary anode conductor 21*a* and the wiring conductor 12*b*. In other words, unnecessary thermions ⊖ not used for light emission are made to flow into the auxiliary anode conductor 21*a* so as to prevent electron oscillations that might occur about the control electrode 19. Similarly, all the unnecessary thermions moving toward the segment anodes 17*a*, 17*d*, 17*e* and 17*g* to which the anode potential is not given are made to flow into the respective nearest ones of the auxiliary anode conductors 21*a* and 21*b*. Therefore, the pattern display section 20 as a whole can be perfectly prevented from the occurrence of the undesirable electron oscillations mentioned above.

Accordingly, the phosphorus luminescent display tube of the present invention is free of outward radiation of electromagnetic waves caused by the above-mentioned electron oscillations. Therefore, such has an excellent advantage in that it generates no noise trouble to the adjacent electronic equipment, such as radios and televisions, sensitive to noises.

In the above-mentioned preferred embodiment shown in FIGS. 2 and 3, the auxiliary anode conductors 21*a* and 21*b* are provided in the area surrounded by and positioned in the vicinity of the seven segment anodes 17*a* to 17*b* constituting the pattern display section 20. However, the arrangement and construction of the auxiliary anode conductors are not limited to those shown in FIGS. 2 and 3. The auxiliary anode conductors may be arranged in the vicinity of the segment anodes so that they surround the pattern display section formed of the foregoing segment anodes.

Another preferred embodiment of the present invention will be hereinafter described with reference to FIG. 4.

Figure 4:
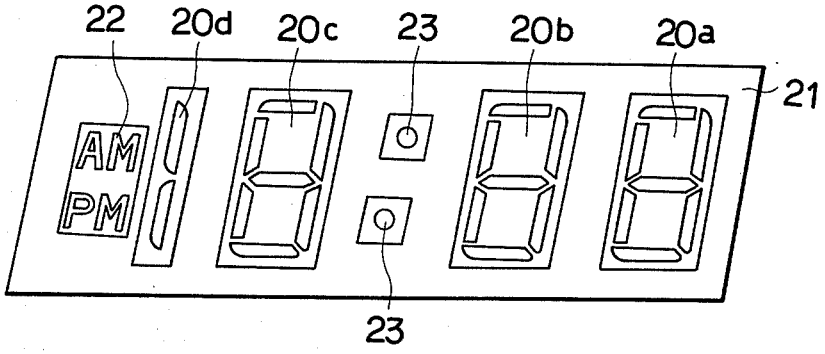
FIG. 4 is a plan view of the essential part of a phosphorus luminescent display tube according to another preferred embodiment of the present invention.

FIG. 4 shows an example of the phosphorus luminescent display tube of a digital time-piece to which the present invention is applied. As shown, this phosphorus luminescent display tube has four pattern display sections 20*a* to 20*d* for time display, an AM/PM display section 22, and a "second-counting" display section 23. In this example, a one-piece auxiliary anode conductor 21 is provided, which surrounds all the above-mentioned display sections 20*a* to 20*d*, 22 and 23 and is substantially on the same level therewith.

In this example, the auxiliary anode conductor 21 is of one piece as mentioned above, and therefore only one wiring conductor is required for this auxiliary anode conductor 21. When the auxiliary anode conductor 21 is to be given the same positive potential as the control electrode as in the case of the static drive system, the desired positive potential may be given to the auxiliary anode conductor 21 only by electrically connecting the conductive part of the support of the control electrode to a portion of the auxiliary anode conductor 21. Thus, it is not necessary to provide a special wiring conductor for the auxiliary anode conductor 21.

The magnitude of the positive potential given to the above-mentioned auxiliary anode conductors 21*a*, 21*b* or 21 may be properly chosen according to the amplitude of electron oscillations accompanied with radio-wave radiation, the voltage of each electrode, the arrangement and construction of each electrode, and the like. Thus, it is not necessarily required that the above-mentioned positive potential should be the same as those given to the control electrode.

The phosphorus luminescent display tube shown in each preferred embodiment mentioned above is of the static drive type. In the case of the phosphorus luminescent display tube of the dynamic drive type, electron oscillations are also sometimes found in the display sections, between the electrodes, etc., depending on the drive conditions and selected digits, as with the display tube of the static drive type. The present invention may be applied to this case, being very useful for preventing radiation of electromagnetic waves that may cause noise troubles in the external electronic equipment.

It will be understood from the foregoing description that the phosphorus luminescent display tube of the triode type according to the present invention has the following features and advantages.

It has a filament for emitting thermions when energized and heated, a plurality of pattern display sections each made up of a plurality of segment anodes, a control electrode provided between the filament and the pattern display sections, and auxiliary anode conductors provided in the vicinity of the segment anodes and substantially on the same level therewith and at all times kept positive with respect to the filament. Thus the auxiliary anode conductors can absorb unnecessary thermions moving toward the segment anodes which are not given an anode potential but kept negative. Consequently, electron oscillations occurring inside the tube during operation can be eliminated and the radiation of electromagnetic waves due to the electron oscillations can also thereby be eliminated.

Accordingly, the phosphorus luminescent display tube of the present invention may be installed in the vicinity of the radio equipment such as radios and televisions, the electronic equipment such as various measuring instruments sensitive to external noises, especially to high-frequency noises. In addition, it has advantages in that it is easy to see, operable on a low voltage, low in power consumption, and so on.

Obviously many modifications and variations of the present invention are possible in the light of the above teachings. It is therefore to be understood that within the scope of the appended claims the invention may be practiced otherwise than as specifically described.

What is claimed as new and desired to be secured by letters patent of the United States is:

1. A phosphorus luminescent display tube comprising:

a vacuum casing made up of a substrate and a light transparent front bulb bonded to each other;

an insulating layer formed on said substrate;

a filamentary cathode provided in said vacuum casing for emitting thermions when energized and heated;

a control electrode provided in said vacuum casing for accelerating and controlling the thermions emitted from said filamentary cathode;

a plurality of pattern display sections, mounted on said insulating layer, each composed of a plurality of segment anodes each coated with a phosphor layer for emitting light when the thermions impinge thereon, said segment anodes being selectively given an anode potential; said control electrode being located between said cathode and said display sections and, auxiliary anode conductors mounted on said insulating layer in the vicinity of and substantially on the same level with the segment anodes of said pattern display sections and having a bias voltage that is kept positive with respect to said filamentary cathode so as to absorb electron oscillations occuring in the vicinity of said segment anodes to which the anode potential is not given.

2. The phosphorus luminescent display tube as set forth in claim 1, wherein said auxiliary anode conductors are formed into one piece.

3. The phosphorus luminescent display tube as set forth in claim 1, wherein said insulating layers include through holes formed therein and further comprising wiring conductors correspondingly connected to said auxiliary anode conductors through said through holes.

4. The phosphorus luminescent display tube as set forth in claim 1, wherein said control electrode continuously has a positive potential equal to said anode potential and wherein said auxiliary anode conductors have a positive potential equal to said anode potential.

5. The phosphorus luminescent display tube as set forth in claim 3, wherein said control electrode continously has a positive potential equal to said anode potential and wherein said auxiliary anode conductors have a positive potential equal to said anode potential.

* * * * *